United States Patent [19]

Corris

[11] 4,006,844

[45] Feb. 8, 1977

[54] APPARATUS FOR OPERATING AN AEROSOL CONTAINER

[75] Inventor: Charles James Corris, Camden, S.C.

[73] Assignee: The Risdon Manufacturing Company, Naugatuck, Conn.

[22] Filed: Apr. 10, 1975

[21] Appl. No.: 566,959

[52] U.S. Cl. ..... 222/70

[51] Int. Cl.[2] ..... B67D 5/28

[58] Field of Search ..... 222/70, 1, 394, 333; 293/70; 74/89.2, 722,

[56] References Cited

UNITED STATES PATENTS

| | | | |
|---|---|---|---|
| 2,585,368 | 2/1952 | Carroll | 74/89.2 X |
| 2,617,315 | 11/1952 | McClelland | 74/89.2 X |
| 2,928,573 | 3/1960 | Edelstein | 222/70 |
| 3,388,834 | 6/1968 | Hart | 222/70 |
| 3,589,563 | 6/1971 | Carragan et al. | 222/70 |

*Primary Examiner*—Stanley H. Tollberg
*Assistant Examiner*—Norman L. Stack, Jr.
*Attorney, Agent, or Firm*—St. Onge Mayers Steward & Reens

[57] ABSTRACT

An apparatus is disclosed for operating an aerosol container equipped at one end with a dispenser valve having a valve stem urged outwardly to a normally closed position away from a depressed open position. The apparatus, which actuates the dispenser valve, comprises a housing constructed to receive at least the valved end of the container. A lever is pivotably mounted in the housing and is operatively associated with the valve stem when the housing receives the valved end of the container. The lever is pivoted to depress the valve stem and open the dispenser valve by a drive assembly that includes a drive shaft rotatably mounted in the housing, a motor for rotating the drive shaft, and a flexible band having one end attached to the lever and an opposite end attached to the drive shaft to be wound thereon.

5 Claims, 3 Drawing Figures

Fig. 1.
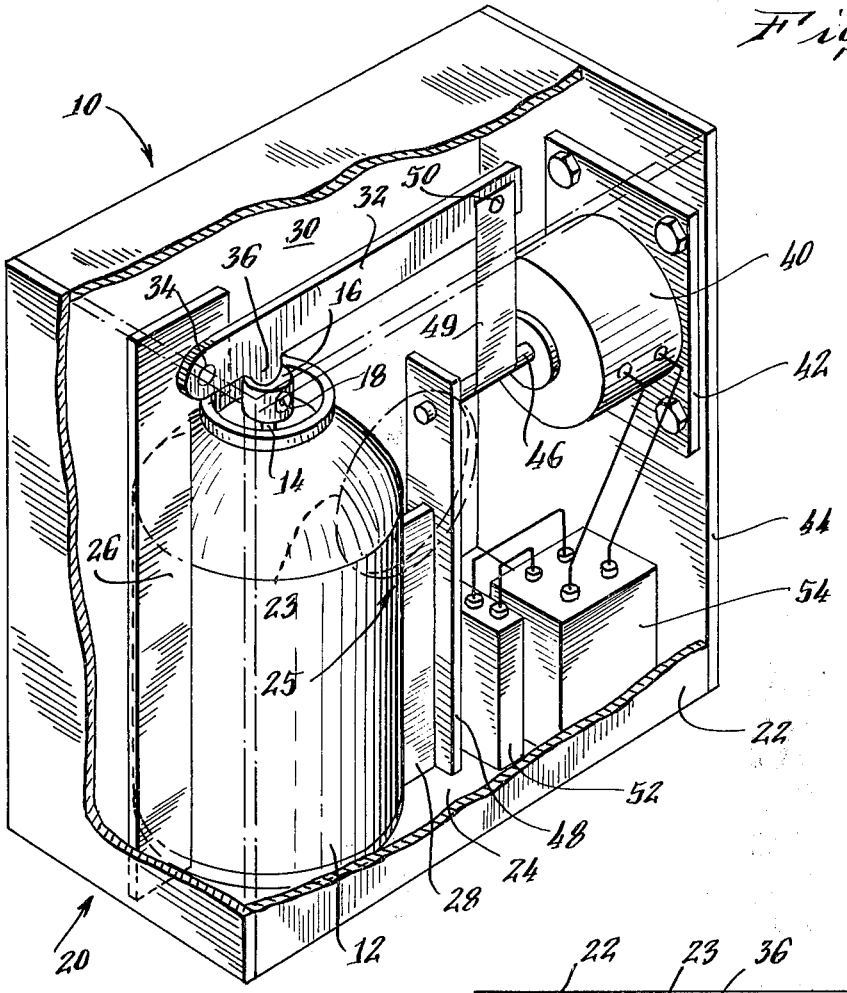
Fig. 2.
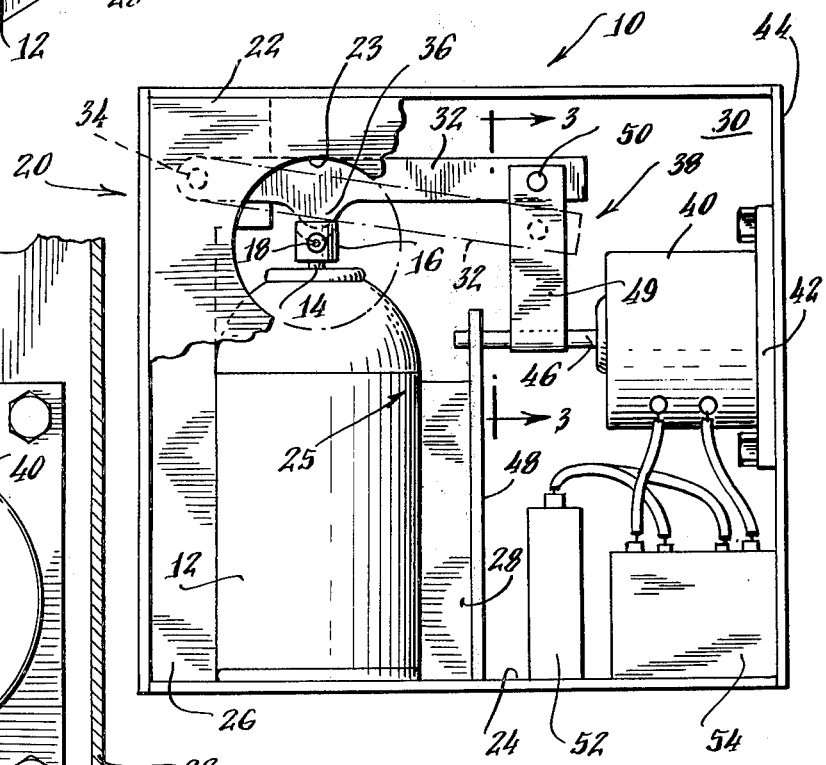
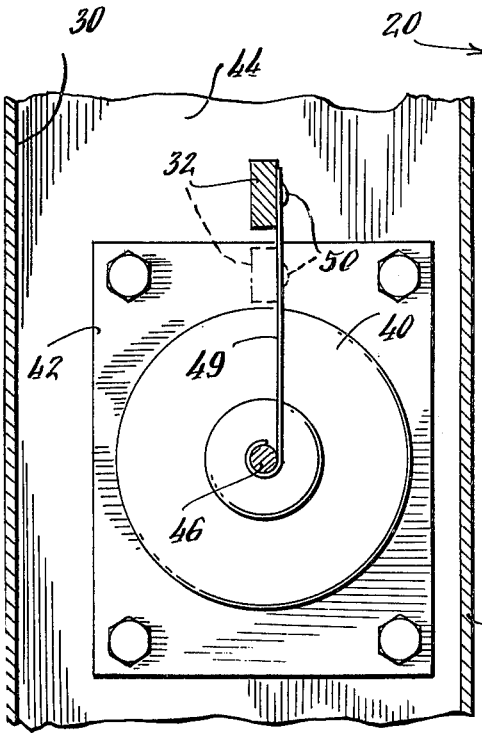
Fig. 3.

APPARATUS FOR OPERATING AN AEROSOL CONTAINER

BACKGROUND OF THE INVENTION

1. Field of the Invention

The present invention relates to an apparatus for operating an aerosol container to dispense a metered quantity of the container's contents and may advantageously be made to do so automatically and periodically.

Pressurized aerosol containers are widely used to store and dispense fluid products such as deodorizers, insecticides, germicides and the like. It is desirable to dispense certain of these products, for example deodorizers and insecticides, automatically and periodically to maintain a preferred concentration of the product in the environment.

These containers usually have a dispenser valve operated through a vertically acting valve stem that projects out of one end of the container. Both the dispensing valve and valve stem are urged outwardly to a normally closed position away from an open depressed position by a spring or other similar device. Accordingly, the dispenser valve is opened by depressing the valve stem and closed by releasing the stem.

There are two basic types of dispenser valves which are operated through valve stems as described above. One continuously dispenses the contents of the container as long as the valve stem is depressed. The other dispenses a single measured quantity of the container's contents each time the valve stem is depressed.

An actuator button, formed with a nozzle, is usually mounted on top of the valve stem. The nozzle directs discharge of the contents of the container and the actuator button provides a convenient means for depressing the stem.

2. Description of the Prior Art

Devices which automatically and periodically operate aerosol containers are presently known. For example, U.S. Pat. No. 3,739,944 (Rogerson) discloses a battery operated apparatus that includes a valve engaging element in the form of a cam driven through a reduction gear train by an electric motor. A timing circuit for periodically operating the electric motor is also disclosed.

A timed spray dispense which includes a lever that engages the actuator button of an aerosol container and is pivoted by a rotating timing cam is disclosed in U.S. Pat. No. 3,018,056 (Montgomery). An electric motor powered by alternating current is used to rotate the timing cam.

U.S. Pat. No. 3,779,425 (Werner) discloses a periodical dispenser for aerosol containers that maintains the dispenser valve of the container in an open position. The contents of the container are dispensed in metered fashion by separate valves in the apparatus.

Other apparatus which periodically actuate an aerosol container are disclosed in U.S. Pat. Nos. 3,543,122 (Klebanoff et al.) and 3,289,886 (Goldsholl et al.). The Klebanoff et al. device employs a DC motor to drive a gear which, in turn, is coupled to a valve actuator by an eccentric drive. The Goldsholl et al. device utilizes a DC motor to drive a cam through a reduction gear train. The cam is engaged by a cam follower that is coupled to a spring loaded valve engaging element.

Apparatus which include gearless drive assemblies that utilize a flexible band wound about a drum or drive shaft are described in U.S. Pat. Nos. 3,592,069 (Welch); 2,617,315 (McClelland); and 2,575,935 (Westerberg). However, none of these patents disclose a device for actuating an aerosol container.

SUMMARY OF THE INVENTION

In the preferred embodiment of the present invention to be described below in detail, the apparatus for operating an aerosol container to meter discharge of its contents includes a gearless mechanical actuator assembly for depressing the valve stem to open the dispenser valve. This actuator assembly, which is mounted in a housing formed to receive at least the valved end of the container, comprises a fixed pivot shaft and a lever pivotally mounted at one end on the pivot shaft. The lever is positioned to be operatively associated with the valve stem when the valved end of the container is received in the housing.

The lever is pivoted to depress the valve stem and open the dispenser valve by a drive assembly that includes a drive shaft rotatably mounted in the housing, a motor for rotatively driving the drive shaft, and a flexible band having one end attached to the free end of the lever and an opposite end attached to the shaft to be wound thereon. Accordingly, the effective length of the band is shortened to pull the free lever end toward the drive shaft when the band is wound thereon by the motor. In this way, the lever is pivoted about the pivot shaft to depress the valve stem.

For convenience, the drive shaft may be the motor shaft.

In the preferred embodiment, the flexible band is made from an inextensible, thin material. It is directly attached to the drive shaft which has a diameter substantially less than the length of travel of the band required to depress the valve stem and open the dispenser valve. This dimensional relationship permits the use of a motor having a relatively low available torque output to achieve relatively large pivoted movement of the lever. Such motors may be driven by low voltage DC power from, for example, two series connected D sized flashlight batteries or one 6 volt battery.

The apparatus of the present invention may advantageously include a timing circuit that automatically and periodically operates the motor to automatically and periodically operate the dispenser valve.

The present invention is mechanically simple and may be practiced with inexpensive materials and components. No gears are employed. Consequently, the reduction gear trains utilized by certain prior art devices are unnecessary. Since this device is preferrably battery operated, it is completely portable and may be used indoors or out without regard to the availability of alternating current.

Accordingly, it is an object of the present invention to provide an inexpensive, uncomplicated, and portable apparatus for operating an aerosol container to dispense the container's contents.

Other objects, aspects, and advantages of the present invention will be pointed out in, or will be understood from, the following detailed description considered together with the accompanying drawings.

BRIEF DESCRIPTION OF THE DRAWINGS

FIG. 1 is a perspective view of the apparatus of the present invention partly broken away to show its details.

FIG. 2 is a front elevational view of this apparatus illustrated with the housing partially disassembled to reveal the various components of the actuator assembly.

FIG. 3 is a view, partly in cross-section, taken through plane 3—3 in FIG. 2 illustrating attachment of the flexible band to both the drive shaft and the lever.

DETAILED DESCRIPTION OF THE PREFERRED EMBODIMENT

FIGS. 1 and 2 illustrate the preferred embodiment of the apparatus 10 of the present invention and an aerosol container 12 received in it.

Aerosol container 12 has standard dimensions and is equipped with any conventional type of vertically actuated aerosol valve assembly which includes a valve stem 14, that when depressed operates a dispenser valve (not shown) mounted inside the container to allow discharge of the pressurized contents in the well-known manner. An actuator button 16, mounted on top of the valve stem 14, provides a convenient means by which the stem may be depressed to open the dispenser valve. Actuator button 16 includes a laterally directed nozzle orifice 18 which directs the discharge of the container's contents.

The apparatus of the present invention includes a generally box-shaped housing 20 having a front wall 22 that is removable to permit insertion of aerosol container 12. Front wall 22 has a large hole 23 that permits free discharge of the contents of the container 12 from nozzle orifice 18. Housing 20 also includes a bottom wall 24 for supporting and two intermediate walls 26 and 28 for laterally positioning container 12. Moreover, housing 20 has a back wall 30 which, in cooperation with front wall 22, positions container 12 in proper front-to-back relation to the actuator assembly.

This actuator assembly, generally indicated at 25, comprises a lever 32 that is pivotably mounted on a pivot shaft 34 mounted on intermediate wall 26. Lever 32 has a depending tab 36 which is located to engage actuator button 16 and, hence, to be operatively associated with valve stem 14 when container 12 is received in housing 20. Tab 36 is formed at a distance from pivot shaft 34 to provide sufficient mechanical advantage to permit easy depression of valve stem 14.

A drive assembly, generally indicated at 38, is mounted in housing 20 to pivot the lever and thus depress the valve stem to open the dispenser valve. This drive assembly includes an electric motor 40 fixed to a mounting plate 42 that is attached to sidewall 44 of housing 20 by suitable means. Motor 40 includes a drive shaft 46 which is supported at its free end by a bracket 48 associated with intermediate wall 28. A thin band 49 of inextensible material links the free end of lever 32, opposite pivot shaft 34, to drive shaft 46. In particular, this band has one end attached to lever 32 by a single rivet which allows the band to pivot relative to lever 32. The opposite band end is attached to shaft 46 to be wound thereon. Accordingly, when motor 40 rotates drive shaft 46, band 49 is wound onto the shaft 46 to pull the free end of lever 32 downward and pivot it about pivot shaft 34 in a clockwise direction as shown in FIG. 2.

As shown in FIGS. 2 and 3, where open and closed positions of the dispenser valve and the actuator assembly 25 are illustrated, the drive shaft desirably has diameter substantially smaller than the length of travel of the flexible band 48 required to depress valve stem 14 and open the dispenser valve. Further, the flexible band should have thickness substantially less than its width so that it has sufficient strength but so that the effective diameter of shaft 46 does not increase appreciably when the band is wound onto it. Material sold under the trademark "Mylar" by the E. I. Dupont de Nemours Co. has these desired band characteristics.

The dimensional relationships set forth in detail above permit use of a motor having low available torque output to effect relatively large pivoted movement of lever 32. Therefore, because it has low power requirements, motor 40 may be driven by, for example, a commercially available 6 volt dry cell battery 52. However, if desired, the apparatus of the present invention may employ a motor which is driven by alternating current such as standard house current.

It is preferable to provide the aerosol container operating apparatus of the present invention with a timing circuit 54 which may, for example, be of the type disclosed in U.S. Pat. No. 3,739,944 (Rogerson). The timing circuit, which is connected between motor 40 and battery 52, operates to control motor 40 to automatically and periodically dispense metered amounts of the container's contents. Further, such a timing circuit is advantageously programmable to permit selection of the time interval between successive actuations of the dispenser valve.

It has been found that after each operation of the actuator assembly the return force of the dispenser valve closing spring is sufficient to rotate lever 32 in a counterclockwise direction. Accordingly, band 48 is pulled upwardly and unwound from drive shaft 46 to return the components of the actuator assembly to their positions shown by solid lines in FIGS. 2 and 3. Therefore, no separate return mechanism for the actuator assembly is needed.

Although a specific embodiment of the present invention has been disclosed above in detail, it is to be understood that this is for purposes of illustration. Modifications may be made to the described apparatus for operating an aerosol container to dispense the container's contents by those skilled in the art in order to adapt it to particular applications.

I claim:

1. An apparatus for operating an aerosol container to dispense the contents thereof, the container having a dispenser valve at one end actuated through a valve stem urged outwardly therefrom to a normally closed position away from a depressed open position, said apparatus comprising:

A. a housing formed to receive at least the valved end of the container;

B. lever means pivotally mounted in said housing, operatively associated with the valve stem when the valved end of the container is received in said housing; and c. means for pivoting said lever means to depress the valve stem including 1. a shaft rotatably mounted in said housing;
2. drive means for rotating said shaft; and
3. a flexible member having one end attached to said lever means and a second end attached to said shaft to be wound thereon; whereby rotation of said shaft by said drive means winds said flexible member thereon to pivot said lever means and depress the valve stem.

2. The apparatus for operating an aerosol container as claimed in claim 1 wherein said flexible member is a flexible band having cross-sectional thickness smaller than its width.

3. The apparatus for operating an aerosol container as claimed in claim 1 wherein said shaft has a diameter that is less than the length of travel of said flexible member required to depress the valve stem to open the dispenser valve.

4. The apparatus for operating an aerosol container as claimed in claim 1 wherein the location of lever means association with the valve stem on said lever means is intermediate the lever means fulcrum point and the location of attachment of the flexible member to said lever means.

5. An apparatus for operating an aerosol container to periodically dispense the contents thereof, the container having a dispenser valve at one end actuated through a valve stem urged outwardly therefrom to a normally closed position away from a depressed open position, said apparatus comprising:

A. a housing formed to receive at least the valved end of the container;

B. a fixed pivot shaft mounted in said housing;

C. a lever pivotably mounted in said housing on said pivot shaft, operatively associated with the valve stem at a location spaced from said pivot shaft when the valved end of the container is received in said housing;

d. means for pivoting said lever to depress the valve stem including 1. a drive shaft rotatably mounted in said housing;
2. motor means for rotatively driving said drive shaft; and
3. a flexible band member having one end attached to said lever at a location spaced from said pivot shaft and spaced from the location of lever association with the valve stem, and an opposite end attached to said shaft to be wound thereon; and E. timer means for periodically actuating said motor means to wind said band member on said drive shaft, pivot said lever about said pivot shaft, and depress the valve stem.

* * * * *